United States Patent [19]

Plantureux

[11] Patent Number: 4,457,056

[45] Date of Patent: Jul. 3, 1984

[54] CARRYING OUT SAID PROCESS AND THE RESULTING JEWELS

[75] Inventor: Alain Plantureux, Montpellier, France

[73] Assignee: Jean-Louis Chancel, Geneva, Switzerland

[21] Appl. No.: 501,747

[22] Filed: Jun. 9, 1983

Related U.S. Application Data

[63] Continuation of Ser. No. 233,768, Feb. 12, 1981, abandoned.

[30] Foreign Application Priority Data

Feb. 25, 1980 [FR] France ..... 80 04057

[51] Int. Cl.[3] ..... B23P 5/00

[52] U.S. Cl. ..... 29/10; 29/160.6; 63/26

[58] Field of Search ..... 63/26, 27, 29 R; 27/10, 27/160.6, 453

[56] References Cited

U.S. PATENT DOCUMENTS

| | | | |
|---|---|---|---|
| 1,499,818 | 7/1924 | Franconetti | 29/10 |
| 1,642,102 | 9/1927 | Colomb | 29/10 |
| 2,436,120 | 2/1948 | Pfeffer . | |
| 2,718,051 | 9/1955 | Cloutier | 29/453 |
| 2,749,597 | 6/1956 | Fus . | |
| 3,261,072 | 7/1966 | Stanley | 29/160.6 |

FOREIGN PATENT DOCUMENTS

| | | | |
|---|---|---|---|
| 627461 | 10/1927 | France | 29/10 |
| 1505450 | 12/1967 | France . | |
| 1506317 | 12/1967 | France . | |
| 2386281 | 11/1978 | France . | |
| 2411586 | 7/1979 | France . | |
| 841565 | 7/1960 | United Kingdom | 63/26 |

*Primary Examiner*—Lowell A. Larson

*Attorney, Agent, or Firm*—Fitzpatrick, Cella, Harper & Scinto

[57] ABSTRACT

The present invention relates to an industrial process for manufacturing jewelry such as rings preferably in precious metal set with stones, consisting in the following operations:

drilling into the said base, of a cylindrical hole of suitable dimensions, provision on the periphery of said hole and at a certain distance of the surface on which the stones will appear, of a pre-setting groove whose dimensions are adapted to those of the stone, and fitting the stone in the pre-setting groove by clipping.

5 Claims, No Drawings

CARRYING OUT SAID PROCESS AND THE RESULTING JEWELS

This application is a continuation of application Ser. No. 233,768, filed Feb. 12, 1981, now abandoned.

The present invention relates to an industrial process for manufacturing jewelry, such as rings, set with stones; the invention also relates to the equipment usable for manufacturing these jewels and the jewels obtained.

To manufacture rings, in precious metal for example, and set with stones, it is generally known to produce first a suitably calibrated ring of the metal, then to make cylinder-shaped holes in the metal, and to place the stone to be set in the hole, the setting of the stone being effected by bringing the metal surrounding the stone over the edge of the latter, by hammering for example.

It is known that it may be advantageous to alter the cross-section of the holes made in the ring (on the inner face thereof) in order to make it square; this operation is normally done by hand, using a file for example.

It is also known to produce rings such as described hereinabove by using claws which, once the stone is set in a suitably provided seating, will be flanged over the stone.

These various processes have kept the production to an essentially artisanal level and it would be an advantage, especially with wedding rings for example, to industrialize the setting operation. This being precisely the object of the invention.

The process according to the invention is characterized in that a non-porous elastic metal base, having good mechanical properties, is used as a starting product, the base, which may be for example a ring of precious metal, is then subjected to the following operations:

drilling into the base, of a cylindrical hole of suitable dimensions, provision on the periphery of the hole and at a certain distance from the surface on which the stones will appear, of a pre-setting groove whose dimensions are adapted to those of the stone, and fitting the stone in the pre-setting groove by clipping.

These various operations are specified hereinafter with particular reference to the example of rings, in which case the base is annular-shaped and the surface on which the stone will be set will be called the outer surface. The holes according to the invention can be made by any known means. The drilling which is carried out on the outer surface of the ring, is effected so that the resulting hole has two diameters: one relatively large diameter close to the outer surface of the ring and a smaller diameter close to the inner surface of the ring. The hole is given this particular structure so that on the one hand, the part of the hole with the larger diameter corresponds (taking into account the pre-setting groove) to the size of the stones to be set, but that, on the other hand, the "inner" part of the ring has still enough metal to provide the desired mechanical strength.

A cylindrical hole with two diameters is easily drilled with a so-called "two-diameter" drill.

The pre-setting groove can also be made by any known means and in particular by means of a boring tool, whose axis is off centre with respect to the axis of the hole in which it is placed.

The shape of the groove is not determinant; it can however be advantageously triangular in cross-section; in effect, the shape of the groove is designed so as to adapt as exactly as possible to the shape of the stone which will be set.

The position of the groove inside the hole is important since the stone is set by "clipping" into the groove. The clipping of the stone implies, when it is fitted, a slight elastic deformation of the metal part forming the "outer" edge or lip of the groove. Said groove should therefore be positioned so that such elastic deformation is possible.

According to preferred embodiments of the invention, at least one groove is provided, by milling for example, on the outer surface of the ring, which groove, cooperating with the pre-setting groove situated in the immediate vicinity of the surface, gives rise to claws which can help the clipping in of the stone. But, as indicated above, these grooves are not absolutely necessary since, by choosing adequately the position and the shape of the pre-setting groove it is possible to obtain sufficiently resilient "edges" to allow the clipping in of the stones without grooves.

The groove or grooves can be made along the whole circumference of the ring whilst going through the middle plane of the holes; it is also possible to place them perpendicularly to the lateral faces of the ring according to the diameter of each hole or at equal distance between these holes. It is conceivable that by carefully selecting the position and the width of the grooves, the cut outlines that are obtained are of very varied shapes and "deformability".

In a further embodiment of the invention, the shape of the opening of the radial cylindrical hole has been modified on the side of the inner face of the ring. It is indeed, known, in jewelry, that it may be advantageous for the opening to be square-, rectangular- or diamond-shaped. To alter the opening, a punch has been designed whose axis is adequately inclined with respect to the axis of the cylindrical hole which punch works by mortising and is driven with a pre-determined movement.

The main advantage of the industrial process according to the invention is that the different operations can be automated in themselves and in succession. Since each individual operation can be automated, this implies that the diameters of the drilling and of the groove can be adjusted exactly to the dimensions of the stone to be set in; this accuracy allows for example the setting of jointed stones. Moreover, the angle of the groove is also adaptable to the stone and to the setting process; finally, it is possible to choose adequately, and always in relation to the stone in particular, the distance of the groove to the outer surface of the ring.

These various operations are possible with known industrial elements working with a precision which can be of the order of one hundredth-millimeter.

Also, they can be programmed one after the other on a single machine or on different machines, this permitting to automatically produce rings in series.

Various types of materials can be used as metal to produce the annular base; precious metals such as gold or platinum can be used, or more ordinary metals or alloys such as lead. The metal used is only required to have the adequate elastic and mechanical properties; for example when the metal is gold, it is advisable to use a gold which has the elasticity of rolled gold and a non-porous structure.

As stones, precious stones such as diamonds for example can be used; synthetic stones or any other stones of sufficient hardness could also be used.

The process according to the invention has been described in reference to the manufacture of rings set with stones; it is clear for any one skilled in the art that the same process and apparatus can be used to produce jewelry of any shape, which are meant to be set with stones. The following non-limitative example illustrates the invention.

The ring to be produced will be for example of size 52, of a type with claws (the inner circumference of the ring being 52 mm), and set with 5/100 carat cut diamonds (of average diameter 2.30 mm). The thickness of the ring will be 1.6 mm and its width 2.7 mm. The gold ring, produced by cutting into sections a tube obtained by continuous casting, having been surfaced and calibrated by known means.

The ring is brought on to an apparatus which will effect the following operations:

drilling of 22 cylindrical holes with a two-diameter drill, the diameter of the outer hole being 2 mm, cutting a groove in each hole with a slot-cutter, said groove being situated at 0.30 mm from the outer surface of the ring, and having a diameter of 2.50 mm and an angle at its apex of the same order as the corresponding angle of the diamond, cutting of grooves of 0.60 mm depth and 1.40 mm width with a straight mill; the grooves are automatically positioned by the machine, on the one hand, according to a diameter of the the cylindrical holes (diameter parallel to the axis of the ring), on the other hand, between the holes (parallel to the axis of the ring, the width of the mill being 0.25 mm and the milling depth being 0.60 mm) and, finally, inside the middle plane of the ring (width of the mill 0.80 mm and milling depth 0.60 mm); these grooves thus determine four claws per hole, after that, each hole receives a small diamond by a simple clipping in operation.

All the preparatory operations of the conventional stone setting operations are thus eliminated.

A machine permitting to carry out industrially the aforesaid operations can be briefly described as follows:

The suitably prepared ring is placed on a spindle which can pivot of a given angle due to outside control means; the ring is attacked first by a two diameter drilling tool which will drill cylindrical holes at each stop position of the ring and, second, by a "quill" (provided at its end with a reamer which, after being positioned in the hole with the larger diameter is set over by pivoting on itself in order to produce the setting groove). This quill will only start operating when an adequate hole in the ring presents itself.

All the operations are controlled by an electronic device which will control in particular:

the angle of rotation of the ring between each machining operation, the depth and duration of the machining operations (drilling of the holes and reaming with the quill), and the synchronizing of the machining operations with the rotation of the ring.

The machine can also comprise a milling device for producing the groove or grooves required on the outer surface of the ring. The operation of the milling device can be controlled electronically (frequency and depth of the grooves) and the device can be electronically coupled with the control system described hereinabove.

To make the square opening on the inner face of the rings, it is possible to use the same machine or to use a different one, since the shaping of this square opening takes longer than any of the aforesaid operations.

The mortising is carried out by introducing in each hole, from the outer surface of the ring, a small punch which is inclined with respect to the axis of the hole and, being driven with a to-and-fro movement along its axis, removes, with a transverse movement, parts of metal from the ring so as to give a substantially truncated structure to the inside of the hole(with circular, square, rectangular or diamond-shaped cross-section, depending on the shape of the chisel and on the way it is controlled).

What is claimed is:

1. Industrial process for manufacturing jewelry, such as rings, by setting stones such as diamonds in a base, preferably of precious metal, which process consists in:

drilling a cylindrical hole of predetermined dimensions into said base;

forming, on the periphery of said hole and at a predetermined distance from the surface on which a stone is to be set, a groove of triangular cross-section;

and fitting the stone in said groove, characterized in that the groove, has the following characteristics:

a hole, on the surface of which the stone to be set will appear, said hole having a diameter slightly smaller than that of the stone to be set;

a base angle for the groove, substantially the same as the cutting angle of the stone to be set; and a sufficiently thin external lip adapted to enable the stone to fit in said groove by clipping, while causing an elastic deformation of said external lip.

2. Process as claimed in claim 1, wherein after the forming of the said groove, additional grooves are milled on the surface on which the stones will be set which additional grooves, cooperating with the first mentioned groove will create claws which will help the clipping in of the stone.

3. Process as claimed in claim 1 or 2, wherein the shape of the hole in its part situated opposite the surface on which the stones will be set, is mortised into a square, rectangular or diamond shape, using a punch which is suitably inclined with respect to the axis of the hole and is driven with a pre-determined movement.

4. Process as claimd in claim 1 or 2, wherein the said base is annular-shaped.

5. The process of claim 3 wherein the said base is annular-shaped.

* * * * *